US011112739B2

(12) United States Patent
Mizuno et al.

(10) Patent No.: US 11,112,739 B2
(45) Date of Patent: Sep. 7, 2021

(54) IMAGE-FORMING APPARATUS PROVIDED WITH FIXING DEVICE INCLUDING FIRST FIXING MEMBER, SECOND FIXING MEMBER, AND PRESSURE MODIFYING MECHANISM MODIFYING NIP PRESSURE OF NIP FORMED THEREBETWEEN

(71) Applicant: BROTHER KOGYO KABUSHIKI KAISHA, Nagoya (JP)

(72) Inventors: Yusuke Mizuno, Nagoya (JP); Fumitake Tajiri, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/127,474

(22) Filed: Dec. 18, 2020

(65) Prior Publication Data

US 2021/0191302 A1 Jun. 24, 2021

(30) Foreign Application Priority Data

Dec. 23, 2019 (JP) ..... JP2019-231492

(51) Int. Cl.
*G03G 15/20* (2006.01)
*G03G 15/00* (2006.01)

(52) U.S. Cl.
CPC ..... *G03G 15/2064* (2013.01); *G03G 15/205* (2013.01); *G03G 15/2028* (2013.01); *G03G 15/2053* (2013.01); *G03G 15/70* (2013.01)

(58) Field of Classification Search
CPC ..... G03G 15/2028; G03G 15/2032; G03G 15/2035; G03G 15/205; G03G 15/2053; G03G 15/2064; G03G 15/70; G03G 15/703
See application file for complete search history.

(56) References Cited

U.S. PATENT DOCUMENTS 8,792,794 B2 * 7/2014 Okuno ..... G03G 15/2028 399/21
2005/0249511 A1 * 11/2005 Sekiguchi ..... G03G 15/70 399/20
2019/0094768 A1 3/2019 Shinoya et al.

FOREIGN PATENT DOCUMENTS

JP 2012-163752 A 8/2012
JP 2013-064961 A 4/2013
JP 2015-230331 A 12/2015
JP 2017-090659 A 5/2017
JP 2019-066508 A 4/2019

* cited by examiner

*Primary Examiner* — Hoang X Ngo
(74) *Attorney, Agent, or Firm* — Merchant & Gould P.C.

(57) ABSTRACT

In an image-forming apparatus, a fixing device includes: a first fixing member; a heater; a motor; a second fixing member; and a pressure modifying mechanism. The second fixing member forms a nip together with the first fixing member. The pressure modifying mechanism modifies a nip pressure at a nip to one of a first nip pressure and a second nip pressure smaller than the first nip pressure. In a first case where a sheet jam occurs in the image-forming apparatus and no sheet exists in the nip, a controller performs: reducing the nip pressure from the first nip pressure to the second nip pressure; and halting rotation of the first fixing member after completed the reducing. In a second case where a sheet jam occurs in the image-forming apparatus and a sheet exists in the nip, the controller performs: the halting; and the reducing after completed the halting.

8 Claims, 9 Drawing Sheets

IMAGE-FORMING APPARATUS PROVIDED WITH FIXING DEVICE INCLUDING FIRST FIXING MEMBER, SECOND FIXING MEMBER, AND PRESSURE MODIFYING MECHANISM MODIFYING NIP PRESSURE OF NIP FORMED THEREBETWEEN

CROSS REFERENCE TO RELATED APPLICATION

This application claims priority from Japanese Patent Application No. 2019-231492 filed Dec. 23, 2019. The entire content of the priority application is incorporated herein by reference.

TECHNICAL FIELD

The present disclosure relates to an image-forming apparatus having a fixing device to fix a developer image on a sheet.

BACKGROUND

A fixing device known in the art includes a heating body and a pressure roller. The heating body is provided with a belt formed in a loop, and a heater and a nip plate disposed inside the belt loop. The pressure roller presses the belt against the nip plate. The heating body can be switched between a pressure contact position in which the heating body contacts the pressure roller, and a separated position in which the heating body is separated from the pressure roller.

SUMMARY

If a sheet becomes jammed during printing on an image-forming apparatus having the fixing device with the conventional structure described above, the rotation of the pressure roller is preferably halted after the position of the heating body is switched from the pressure contact position to the separated position for the following reason. If the position of the heating body were switched from the pressure contact position to the separated position after first halting rotation of the pressure roller, for example, the pressure roller would continue rotating at a strong nip pressure until rotation of the pressure roller comes to a halt. Accordingly, the belt interposed between the pressure roller and the nip plate may become worn and incur damage.

However, if the position of the heating roller is switched prior to halting rotation of the pressure roller when the sheet becomes jammed in the fixing device, the jammed sheet may become wrapped around the rotating pressure roller.

In view of the foregoing, it is an object of the present disclosure to prevent a sheet from becoming wrapped around a member in the fixing device when the sheet becomes jammed in the fixing device.

In order to attain the above and other objects, the present disclosure provides an image-forming apparatus including: an image-forming section; a sheet feeder; a fixing device; and a controller. The image-forming section is configured to form a developer image on a sheet. The sheet feeder is configured to feed a sheet toward the image-forming section. The fixing device is configured to fix a developer image on a sheet. The fixing device includes: a first fixing member; a heater; a motor; a second fixing member; and a pressure modifying mechanism. The first fixing member is configured to rotate. The heater is configured to heat the first fixing member. The motor is configured to drive the first fixing member. The second fixing member is configured to form a nip together with the first fixing member. The second fixing member is rotatable by following the first fixing member rotating. The pressure modifying mechanism is configured to modify a nip pressure at the nip to one of a first nip pressure and a second nip pressure smaller than the first nip pressure. The controller is configured to perform: energizing the heater to heat the first fixing member; rotating the motor to rotate the first fixing member; controlling the pressure modifying mechanism to set the nip pressure to the first nip pressure; and controlling the sheet feeder to feed a sheet toward the image-forming section. In a first case where a sheet jam occurs in the image-forming apparatus and no sheet exists in the nip, the controller performs: reducing the nip pressure from the first nip pressure to the second nip pressure; and halting rotation of the first fixing member after completed the reducing. In a second case where a sheet jam occurs in the image-forming apparatus and a sheet exists in the nip, the controller performs: the halting; and the reducing after completed the halting.

BRIEF DESCRIPTION OF THE DRAWINGS

The particular features and advantages of the disclosure as well as other objects will become apparent from the following description taken in connection with the accompanying drawings, in which:

FIG. 5(*b*) is a cross-sectional view of the configuration around a nip area in the fixing device when the cam is at the first cam position, the arm body is in the first orientation, and the nip pressure is the maximum nip pressure;

FIG. 6(*b*) is a cross-sectional view of the configuration around the nip area in the fixing device when the cam is at the second cam position, the arm body is in the second orientation, and the nip pressure is the minimum nip pressure;

DETAILED DESCRIPTION

Figure 1:
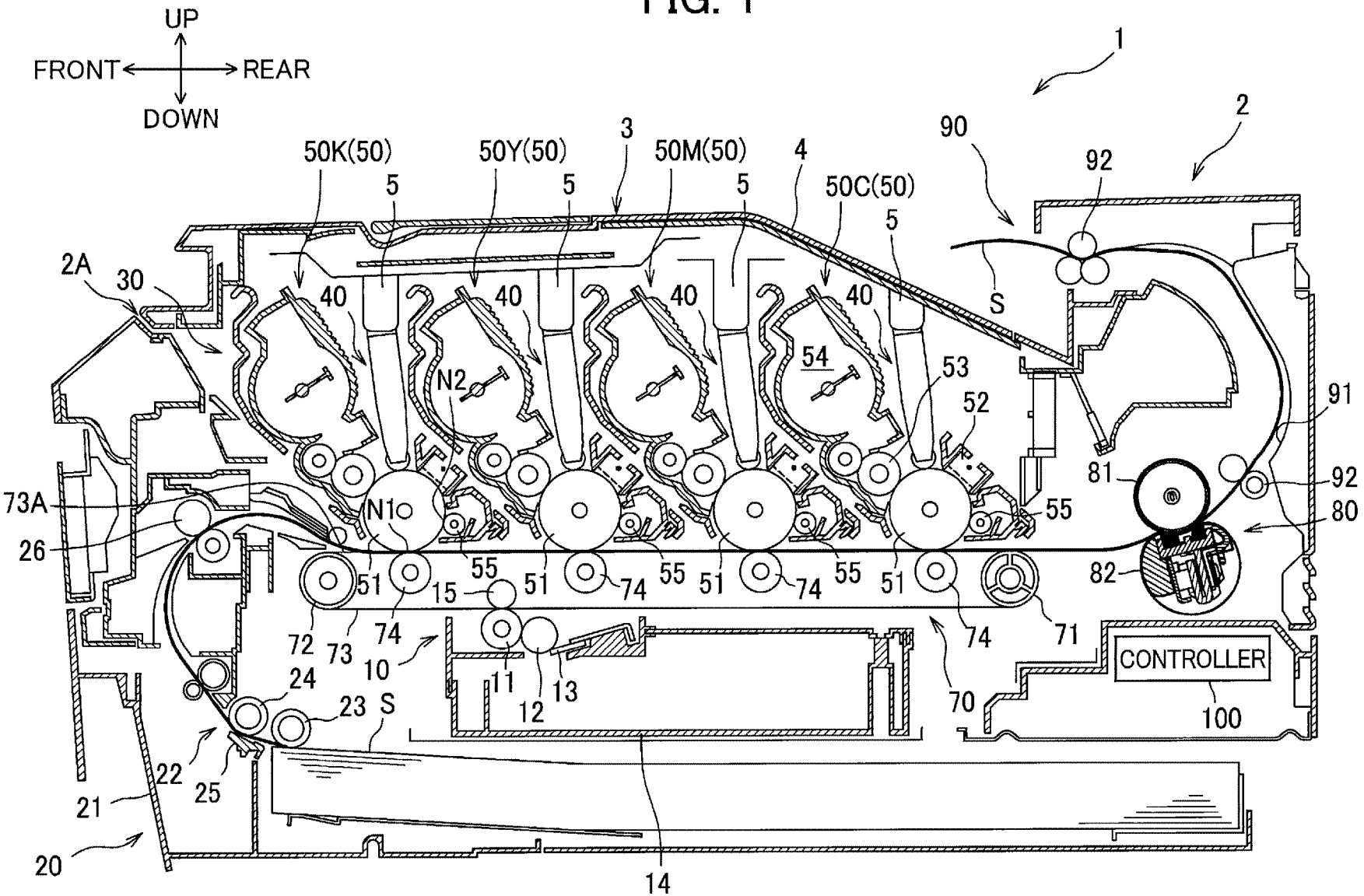
FIG. 1 is a cross-sectional view of a color printer according to an embodiment of the present disclosure.

Next, an embodiment of the present disclosure will be described while referring to the accompanying drawings. FIG. 1 shows a color printer 1 as an example of the image-forming apparatus. The color printer 1 is provided with a main casing 2 and, within the main casing 2, a sheet-feeding section 20 for supplying sheets S to be printed, an image-forming section 30 for forming toner images on the sheets S supplied by the sheet-feeding section 20, a fixing device 80 for fixing toner images on the sheets S, a paper-discharging section 90 for discharging sheets S from the main casing 2 after images have been formed on and fixed to the sheets S, and a controller 100.

An opening 2A is formed in the top of the main casing 2. An upper cover 3 is pivotally movably supported on the main casing 2, and opens and closes the opening 2A. The top surface of the upper cover 3 constitutes a paper discharge tray 4 that collects sheets S discharged from the main casing 2. A plurality of LED-mounting members 5 is provided on the bottom surface of the upper cover 3. Each LED-mounting member 5 retains an LED unit 40.

The sheet-feeding section 20 is disposed in the bottom section of the main casing 2. The sheet-feeding section 20 is provided with a sheet tray 21 that is detachably mounted in the main casing 2, and a sheet-feeding mechanism 22 that conveys sheets S from the sheet tray 21 toward the image-forming section 30. The sheet-feeding mechanism 22 includes a pickup roller 23, a separating roller 24, a separating pad 25, and registration rollers 26.

In the sheet-feeding section 20, the pickup roller 23 feeds sheets S from the sheet tray 21. Subsequently, the separating roller 24 and the separating pad 25 separate the sheets S fed by the pickup roller 23, ensuring one sheet is fed at a time. Thereafter, the registration rollers 26 straighten the leading edge of the sheet S before conveying the sheet S toward the image-forming section 30. Specifically, the registration rollers 26 are in a halted state when a sheet S is conveyed thereto. As the sheet S contacts the halted registration rollers 26, the leading edge of the sheet S becomes aligned with the registration rollers 26, thereby removing skew in the sheet S. Subsequently, the registration rollers 26 begins rotating to convey the sheet S onward.

The image-forming section 30 includes the four LED units 40, four process cartridges 50, a transfer unit 70, and a belt cleaner 10.

The LED units 40 are coupled to respective LED-mounting members 5 so as to be capable of pivoting relative to the LED-mounting members 5. Positioning members provided in the main casing 2 support the LED units 40 in appropriate positions.

The process cartridges 50 are juxtaposed in the front-rear direction between the upper cover 3 and the sheet-feeding section 20. Each process cartridge 50 is configured of a photosensitive drum 51, a charger 52, a developing roller 53, a toner-accommodating chamber 54 that accommodates toner (an example of the developer), a cleaning roller 55, and an agitator 56.

The process cartridges 50 are represented by the symbols 50K, 50Y, 50M, and 50C to indicate the color of toner they accommodate. Thus, the process cartridge 50K accommodates black (K) toner, the process cartridge 50Y accommodates yellow (Y) toner, the process cartridge 50M accommodates magenta (M) toner, and the process cartridge 50C accommodates cyan (C) toner. The process cartridges 50K, 50Y, 50M, and 50C are arranged in the order given beginning from the upstream side in the conveying direction of the sheets S. Note that the same symbols K, Y, M, and C are also appended to the photosensitive drums 51, the developing rollers 53, and the cleaning rollers 55 in the specification and the drawings to identify the colors of toner (i.e., black, yellow, magenta, and cyan) used with the corresponding members.

The photosensitive drums 51 are members capable of carrying toner. Specifically, each LED unit 40 exposes a surface of a corresponding photosensitive drum 51 so as to form an electrostatic latent image thereon, and an area of the photosensitive drum 51, on which the electrostatic latent image is formed, carries tonner. One photosensitive drum 51 is provided in each of the process cartridges 50. The photosensitive drums 51 are arranged at intervals along the conveying direction of the sheet S.

The developing rollers 53 are rollers that carry toner. The developing rollers 53 are configured to contact the corresponding photosensitive drums 51 in order to supply toner to the electrostatic latent images formed on the photosensitive drums 51.

The developing rollers 53 are capable of contacting or separating from the corresponding photosensitive drums 51. The controller 100 controls a switching mechanism SW described later (see FIG. 7) to switch the developing rollers 53 between a contact position and a separated position. Specifically, all developing rollers 53K, 53Y, 53M, and 53C are made to contact the corresponding photosensitive drums 51K, 51Y, 51M, and 51C in a color mode in order to supply toner to the corresponding photosensitive drums 51K, 51Y, 51M, and 51C. However, only the black developing roller 53K is placed in contact with the photosensitive drum 51K in a monochrome mode while the developing rollers 53Y, 53M, and 53C for the three remaining colors are separated from their corresponding photosensitive drums 51Y, 51M, and 51C. In a cleaning process described later, all developing rollers 53K, 53Y, 53M, and 53C are separated from the corresponding photosensitive drums 51K, 51Y, 51M, and 51C.

The cleaning rollers 55 are members capable of recovering toner from the corresponding photosensitive drums 51. One cleaning roller 55 is provided adjacent to the corresponding photosensitive drum 51.

The transfer unit 70 is disposed between the sheet-feeding section 20 and the process cartridges 50. The transfer unit 70 is provided with a drive roller 71, a follow roller 72, a transfer belt 73, and transfer rollers 74.

The drive roller 71 and the follow roller 72 are arranged parallel to each other while being separated in the front-rear direction. The transfer belt 73 is an endless belt that is stretched around the drive roller 71 and the follow roller 72. The transfer belt 73 is a member for conveying the sheets S. The outer surface of the transfer belt 73 contacts the photosensitive drums 51. Four of the transfer rollers 74 are disposed inside the transfer belt 73 at positions opposing corresponding photosensitive drums 51.

The transfer belt 73 is interposed between the photosensitive drums 51 and the corresponding transfer rollers 74. Sheets S are conveyed by the transfer belt 73 and the photosensitive drums 51.

The belt cleaner 10 is a device that slides against the transfer belt 73 in order to recover toner and other matter that has become deposited on the transfer belt 73. The belt cleaner 10 is disposed beneath the transfer belt 73. Specifically, the belt cleaner 10 is provided with a sliding-contact roller 11, a recovery roller 12, a blade 13, and a waste toner receptacle 14.

The sliding-contact roller 11 is disposed so as to contact the outer surface of the transfer belt 73. The transfer belt 73 is interposed between the sliding-contact roller 11 and a backup roller 15 provided inside the transfer belt 73. The sliding-contact roller 11 recovers matter deposited on the transfer belt 73.

The recovery roller 12 is a roller that slides in contact with the sliding-contact roller 11 to recover matter deposited on the sliding-contact roller 11. The blade 13 is disposed so as to slide against the recovery roller 12 and scrapes off matter recovered on the recovery roller 12. Matter scraped off the recovery roller 12 falls into the waste toner receptacle 14.

The fixing device 80 is provided with a first fixing member 81 and a second fixing member 82. The structure of the fixing device 80 will be described later in greater detail.

With the image-forming section 30 having the structure described above, the charger 52 applies a uniform charge to the surface of the photosensitive drum 51. Subsequently, the charged surface of the photosensitive drum 51 is exposed by the LED unit 40, forming an electrostatic latent image on the photosensitive drum 51 based on image data. Thereafter, toner is supplied from the developing roller 53 to the electrostatic latent image to form a toner image that is carried on the photosensitive drum 51.

The toner image formed on each photosensitive drum 51 is transferred onto a sheet S carried on the transfer belt 73 as the sheet S passes between the photosensitive drum 51 and the corresponding transfer roller 74 disposed inside the transfer belt 73. The toner images transferred onto the sheet S are thermally fixed to the sheet S as the sheet S passes between the first fixing member 81 and the second fixing member 82.

The paper-discharging section 90 is provided with a discharge-side conveying path 91, and a plurality of conveying rollers 92. After toner images are thermally fixed to a sheet S, the conveying rollers 92 convey the sheet S along the discharge-side conveying path 91 and discharge the sheet S from the main casing 2 to be collected in the paper discharge tray 4.

Figure 2:
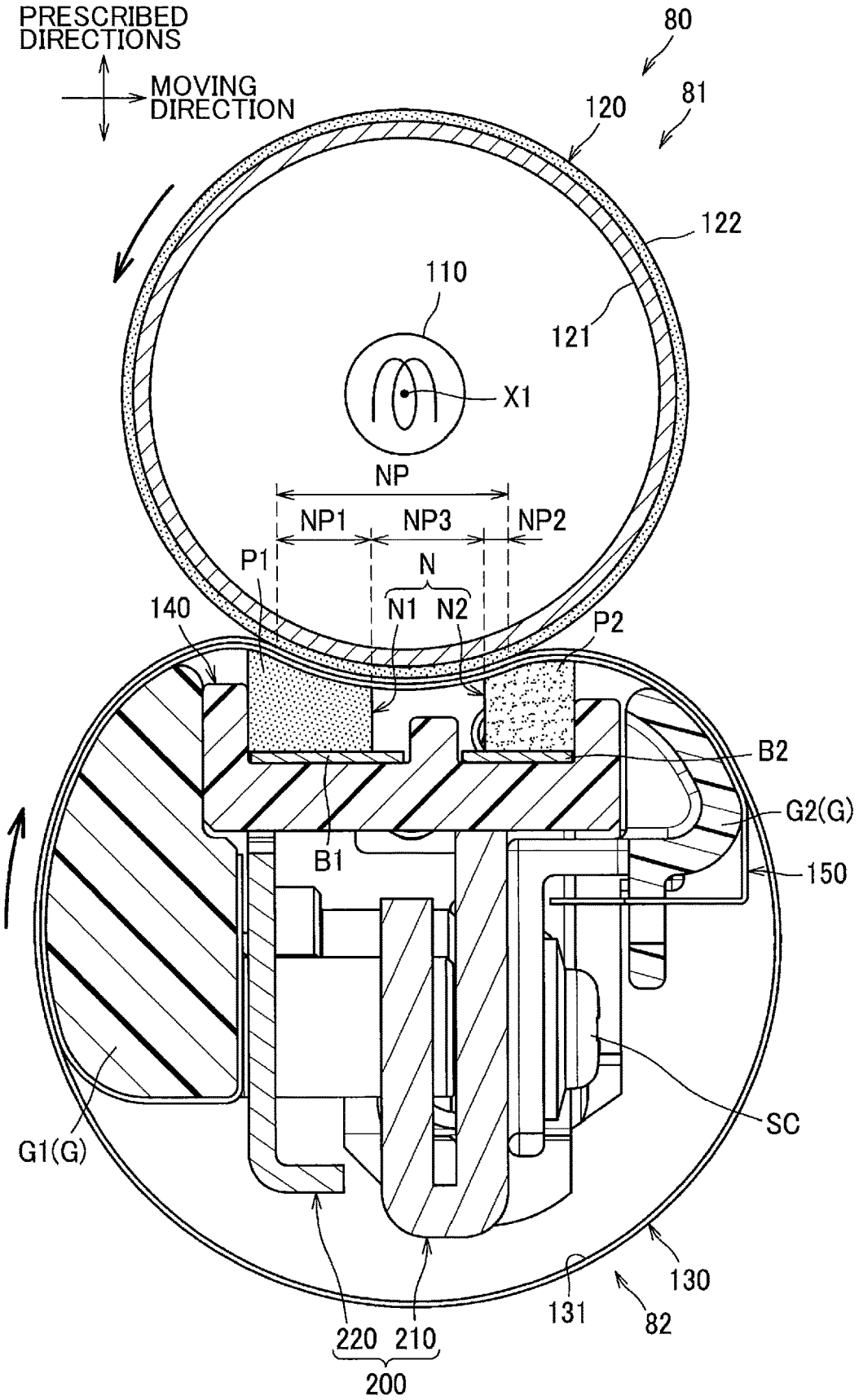
FIG. 2 is a cross-sectional view of a fixing device in the color printer according to the embodiment of the present disclosure.

As shown in FIG. 2, the fixing device 80 is provided with a heater 110, and a pressure-modifying mechanism 300 described later (see FIG. 4), in addition to the first fixing member 81 and the second fixing member 82 described above. The pressure-modifying mechanism 300 described later urges the second fixing member 82 against the first fixing member 81. In the following description, the direction in which the second fixing member 82 is urged against the first fixing member 81 and its opposite direction will be called the "prescribed directions." In the present embodiment, the prescribed directions are orthogonal to width directions and a moving direction described later and are the directions in which the first fixing member 81 and the second fixing member 82 oppose each other.

The first fixing member 81 has a rotatable rotor 120. In a state where the second fixing member 82 is urged against the first fixing member 81, a nip area NP is formed therebetween. The second fixing member 82 is provided with a belt 130, a nip-forming member N, a holder 140, a stay 200, a belt guide G, and a sliding sheet 150. In the following description, the width directions of the belt 130 will simply be called "width directions." The width directions are the directions in which the rotational axis X1 of the rotor 120 extends. Hence, the width directions are the same as the axial directions of the rotor 120. The width directions are orthogonal to the prescribed directions.

The heater 110 is a halogen lamp. When powered, the heater 110 emits light and generates heat. The radiant heat generated by the heater 110 heats the rotor 120. The heater 110 extends through the inside of the rotor 120 along the rotational axis X1 of the same.

The rotor 120 is a cylindrical roller elongated in the width direction. The rotor 120 is heated by the heater 110. The rotor 120 has a tubular body 121 formed of metal or the like, and an elastic layer 122 covering the outer surface of the tubular body 121. The elastic layer 122 is formed of a rubber, such as silicone rubber. The rotor 120 is rotatably supported in side frames 83 described later (see FIG. 4). A fixing motor M2 (described later with reference to FIG. 7) provided in the main casing 2 inputs a drive force for driving the rotor 120 to rotate counterclockwise in FIG. 2.

The belt 130 is a long cylindrical shaped member having flexibility. While not shown in the drawings, the belt 130 has a base formed of a metal, resin, or the like, and a release layer covering the outer surface of the base. Owing to friction between the belt 130 and the rotor 120 or a sheet S interposed between the belt 130 and the rotor 120, the belt 130 rotates clockwise in FIG. 2 by following the rotor 120 rotating. Grease or other lubricant is applied to an inner circumferential surface 131 of the belt 130. The nip-forming member N, the holder 140, the stay 200, the belt guide G, and the sliding sheet 150 are all disposed in the interior space defined by the cylindrical belt 130.

Hence, the nip-forming member N, the holder 140, the stay 200, the belt guide G, and the sliding sheet 150 are surrounded by the belt 130.

Figure 3:
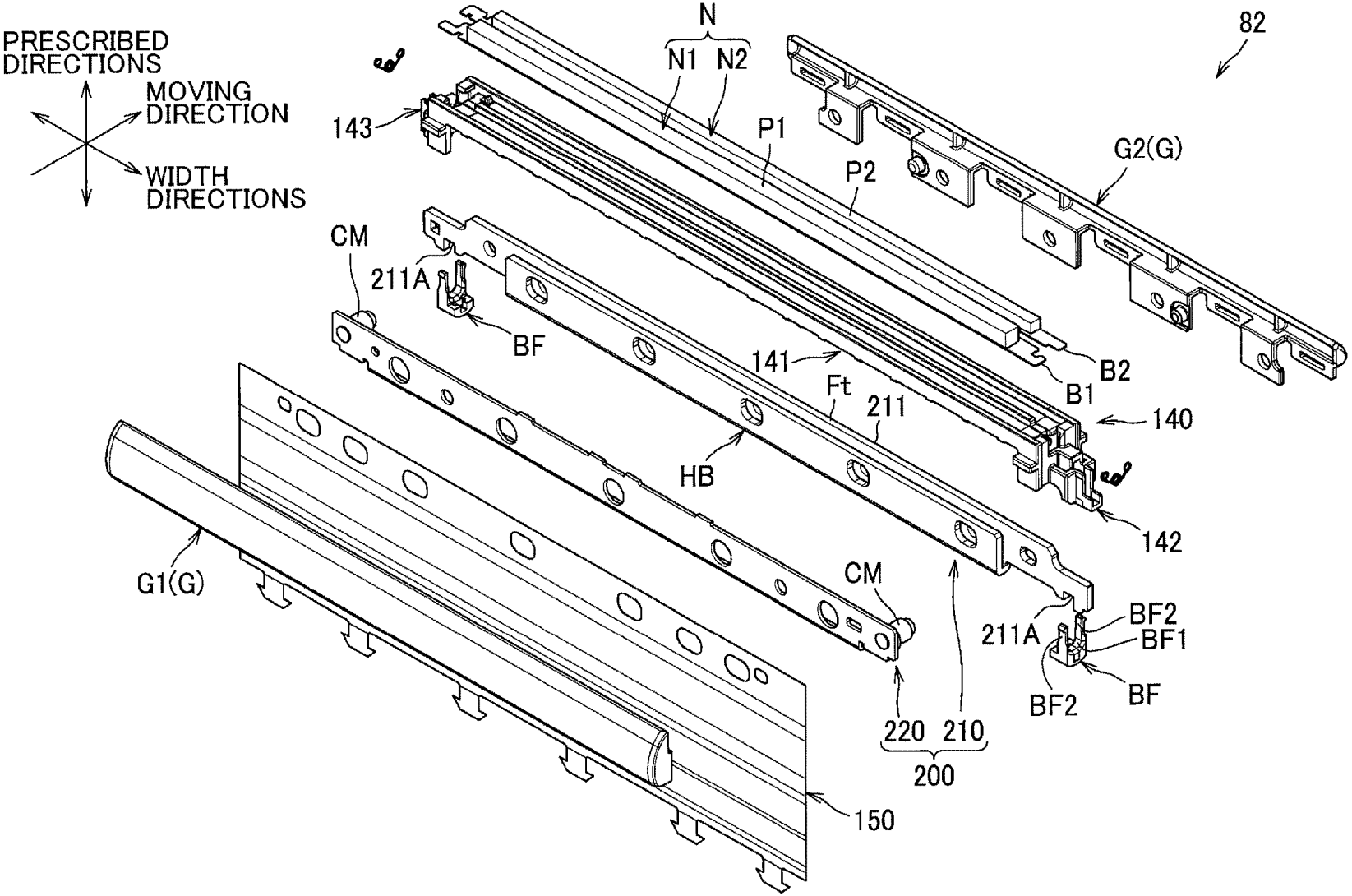
FIG. 3 is an exploded perspective diagram illustrating components disposed in the interior space defined by a belt in the fixing device.

As shown in FIGS. 2 and 3, the nip-forming member N together with the rotor 120 nips a portion of belt 130 to form the nip area NP. The nip-forming member N includes an upstream nip-forming member N1 and a downstream nip-forming member N2.

The upstream nip-forming member N1 has an upstream pad P1, and an upstream fixing plate B1. The upstream pad P1 is a rectangular parallelepiped shaped member. The upstream pad P1 is formed of a rubber, such as silicone rubber. The upstream pad P1 together with the rotor 120 nips a portion of the belt 130 to form an upstream nip area NP1.

In the following description, the direction in which the belt 130 moves in the upstream nip area NP1 and the nip area NP will simply be called the "moving direction." In the present embodiment, the moving direction is a direction that follows the outer circumferential surface of the rotor 120. However, since this direction is substantially orthogonal to the prescribed directions and the width directions in the nip area NP, the moving direction is shown in the drawings to be a direction orthogonal to the prescribed directions and width directions. Note that the moving direction is identical to the conveying direction of the sheet S in the nip area NP.

The upstream pad P1 is fixed to the surface of the upstream fixing plate B1 that opposes the rotor 120. The upstream fixing plate B1 is a member formed of a metal or other material that is harder than the upstream pad P1.

The downstream nip-forming member N2 is arranged on the downstream side of the upstream nip-forming member N1 in the moving direction and is spaced apart from the upstream nip-forming member N1. The downstream nip-forming member N2 has a downstream pad P2, and a downstream fixing plate B2.

The downstream pad P2 is a rectangular parallelepiped shaped member. The downstream pad P2 is formed of a rubber, such as silicone rubber. The downstream pad P2 together with the rotor 120 nips a portion of the belt 130 to form a downstream nip area NP2. The downstream pad P2 is separated from the upstream pad P1 in the rotating direction of the belt 130.

Consequently, an intermediate nip area NP3 in which the second fixing member 82 applies no direct pressure to the first fixing member 81 exists between the upstream nip area NP1 and the downstream nip area NP2. Although the belt 130 contacts the rotor 120 in this intermediate nip area NP3, the belt 130 applies almost no pressure to the rotor 120 since there exists no member on the opposite side of the rotor 120 with respect to the belt 130 in this area. Hence, a sheet S passing through the intermediate nip area NP3 is heated by the rotor 120 but receives almost no pressure. In the present embodiment, the region from the upstream side of the upstream nip area NP1 to the downstream side of the downstream nip area NP2, i.e., the entire region on the outer surface of the belt 130 in contact with the rotor 120 is called the nip area NP. Thus, the nip area NP in the present embodiment includes an area receiving no pressure from the upstream pad P1 and downstream pad P2.

In other words, the nip area NP is an area from an upstream end point where the belt 130 is in contact with the rotor 120 in the moving direction to a downstream end point where the belt 130 is in contact with the rotor 120 in the moving direction. The belt 130 and the rotor 120 may be in contact with each other at a single point. In this case, the nip area is a single point of nip. Further, actions such as "nip", "pinch", and "grip" indicate that two components, such as the first fixing member 81 and the second fixing member 82, contact with each other with pressures generated therebetween. Thus, the nip area is an area or point in which two components contact with each other and which includes at least a nip where the two components are in contact with each other.

The downstream pad P2 is fixed to the surface of the downstream fixing plate B2 that opposes the rotor 120. The downstream fixing plate B2 is a member formed of metal or the like that is harder than the downstream pad P2.

Note that the hardness of the upstream pad P1 is greater than the hardness of the elastic layer 122 provided on the rotor 120. Further, the hardness of the downstream pad P2 is greater than the hardness of the upstream pad P1.

The term "hardness" in this specification denotes Shore hardness measured by a durometer according to the method specified in ISO 7619-1. Shore hardness is a value based on depth of indentation when a prescribed presser foot is pressed into a test piece under specified conditions. As an example, if the Shore hardness of the elastic layer 122 is 5 in the present embodiment, the Shore hardness of the upstream pad P1 is preferably between 6 and 10 while the Shore hardness of the downstream pad P2 is preferably between 70 and 90.

The holder 140 is a member that holds the nip-forming member N. The holder 140 is formed of a heat-resistant resin or the like. The holder 140 has a holder body 141, and two engaging parts 142 and 143 (see FIG. 3).

The holder body 141 is the member that holds the nip-forming member N. The majority of the holder body 141 is disposed within the range of the belt 130 in the width direction. The holder body 141 is supported by the stay 200.

The engaging parts 142 and 143 extend outward in the width directions from respective ends of the holder body 141. The engaging parts 142 and 143 are positioned outside the range of the belt 130 in the width direction. The engaging parts 142 and 143 engage with respective widthwise ends of a first stay 210 described later.

The stay 200 is a member that supports the holder 140. The stay 200 is positioned on the opposite side of the nip-forming member N with respect to the holder 140. The stay 200 is provided with the first stay 210, and a second stay 220. The second stay 220 is coupled to the first stay 210 by coupling members CM (see FIG. 3).

The first stay 210 is the member that supports the holder body 141 of the holder 140. The first stay 210 is formed of metal or the like. The first stay 210 has a base part 211, and a hemmed edge HB that has been bent in a hemming process.

The base part 211 has a contact surface Ft along the edge facing the holder 140 for contacting the holder body 141 of the holder 140. The contact surface Ft is a flat surface that is perpendicular to the prescribed directions.

The base part 211 has a load input part 211A disposed on each widthwise end. The load input parts 211A receive force from the pressure-modifying mechanism 300 described later (see FIG. 4). The load input parts 211A are formed in the edge of the base part 211 on the side opposite the nip-forming member N in the prescribed direction. The load input parts 211A are recessed parts opening toward the side opposite the nip-forming member N in the prescribed direction.

Buffer members BF are mounted in the respective load input parts 211A. The buffer members BF are formed of a resin or the like. The buffer members BF suppress rubbing between the metal base part 211 and metal arms 310 described later (see FIG. 4). Each buffer member BF has a fitting part BF1 that fits into the corresponding load input part 211A, and a pair of leg parts BF2 disposed respectively on the upstream side and downstream side of the outer widthwise end of the corresponding base part 211 in the moving direction.

The belt guide G is a member that guides the inner circumferential surface 131 of the belt 130. The belt guide G is formed of a heat-resistant resin or the like. The belt guide G has an upstream guide G1 and a downstream guide G2.

The sliding sheet 150 is a rectangular sheet provided to reduce frictional resistance between the belt 130 and the pads P1 and P2. The sliding sheet 150 is interposed between the inner circumferential surface 131 of the belt 130 and the pads P1 and P2 within the nip area NP. The sliding sheet 150 is formed of an elastically deformable material. While any suitable material may be used for the sliding sheet 150, a resin sheet containing polyimide is employed in the present embodiment.

As shown in FIG. 2, the upstream guide G1, the downstream guide G2, and the first stay 210 are jointly fastened by a screw SC.

Figure 4:
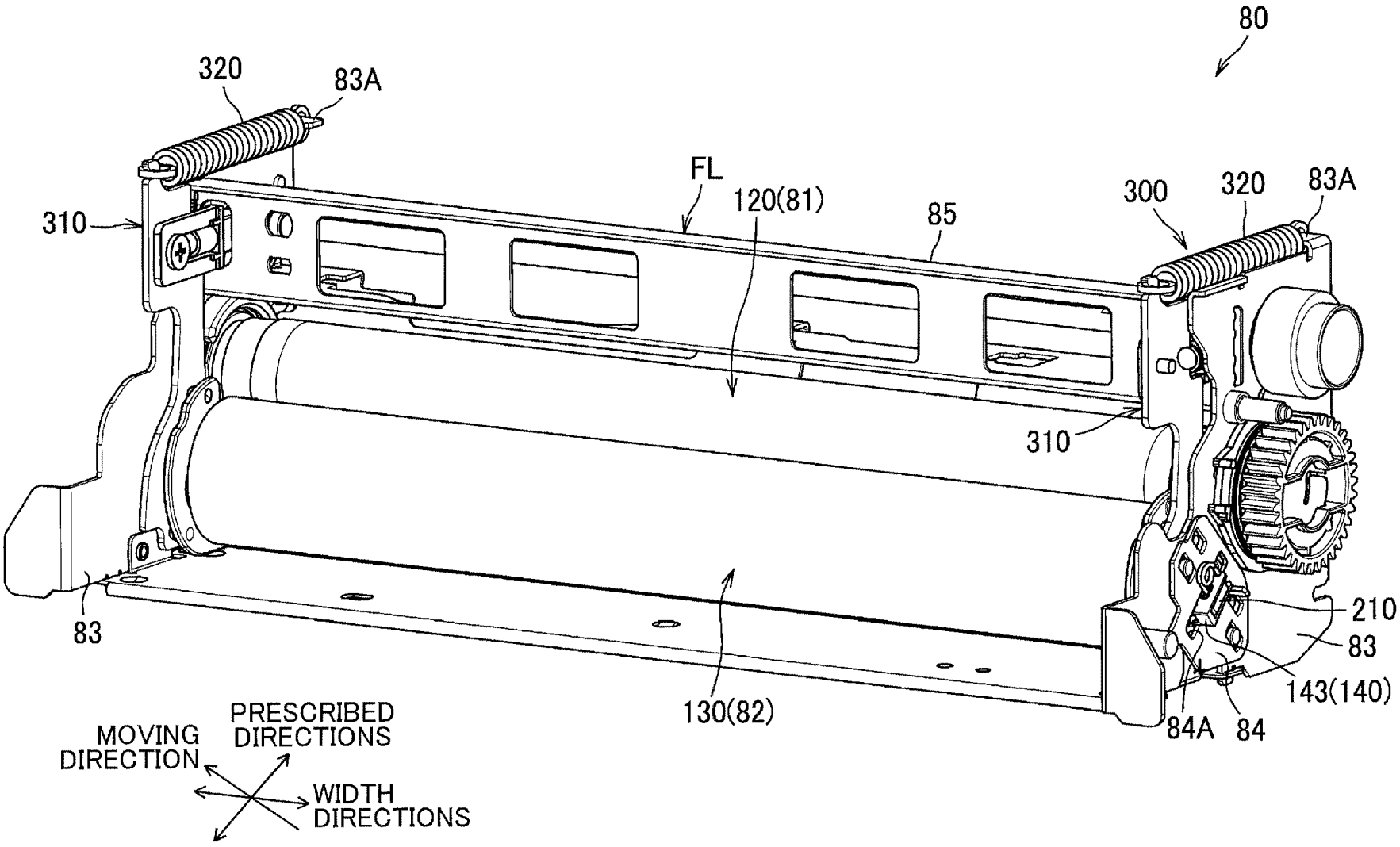
FIG. 4 is a perspective diagram illustrating a pressure-modifying mechanism of the color printer according to the embodiment of the present disclosure.

As shown in FIG. 4, the fixing device 80 is further provided with a frame FL, and a pressure-modifying mechanism 300. The frame FL is formed of metal or the like and supports the first fixing member 81 and the second fixing member 82. The frame FL includes two side frames 83, two brackets 84, and a connecting frame 85. The side frames 83 and the brackets 84 are disposed on widthwise ends of the first fixing member 81 and the second fixing member 82. The connecting frame 85 connects the two side frames 83.

The side frames 83 are frame members that support the first fixing member 81 and the second fixing member 82. Each side frame 83 has a spring-engaging part 83A. One end of a first spring 320 described later is engaged in each spring-engaging part 83A.

The brackets 84 are fixed to corresponding side frames 83. The brackets 84 are members that support the second fixing member 82 so that the second fixing member 82 can move in the prescribed directions. Specifically, each bracket 84 has a first elongate hole 84A elongated in the prescribed directions. The elongate holes 84A support corresponding ends of the first stay 210 via the engaging parts 142 and 143 of the holder 140 so that the first stay 210 can move in the prescribed directions.

Figure 5:
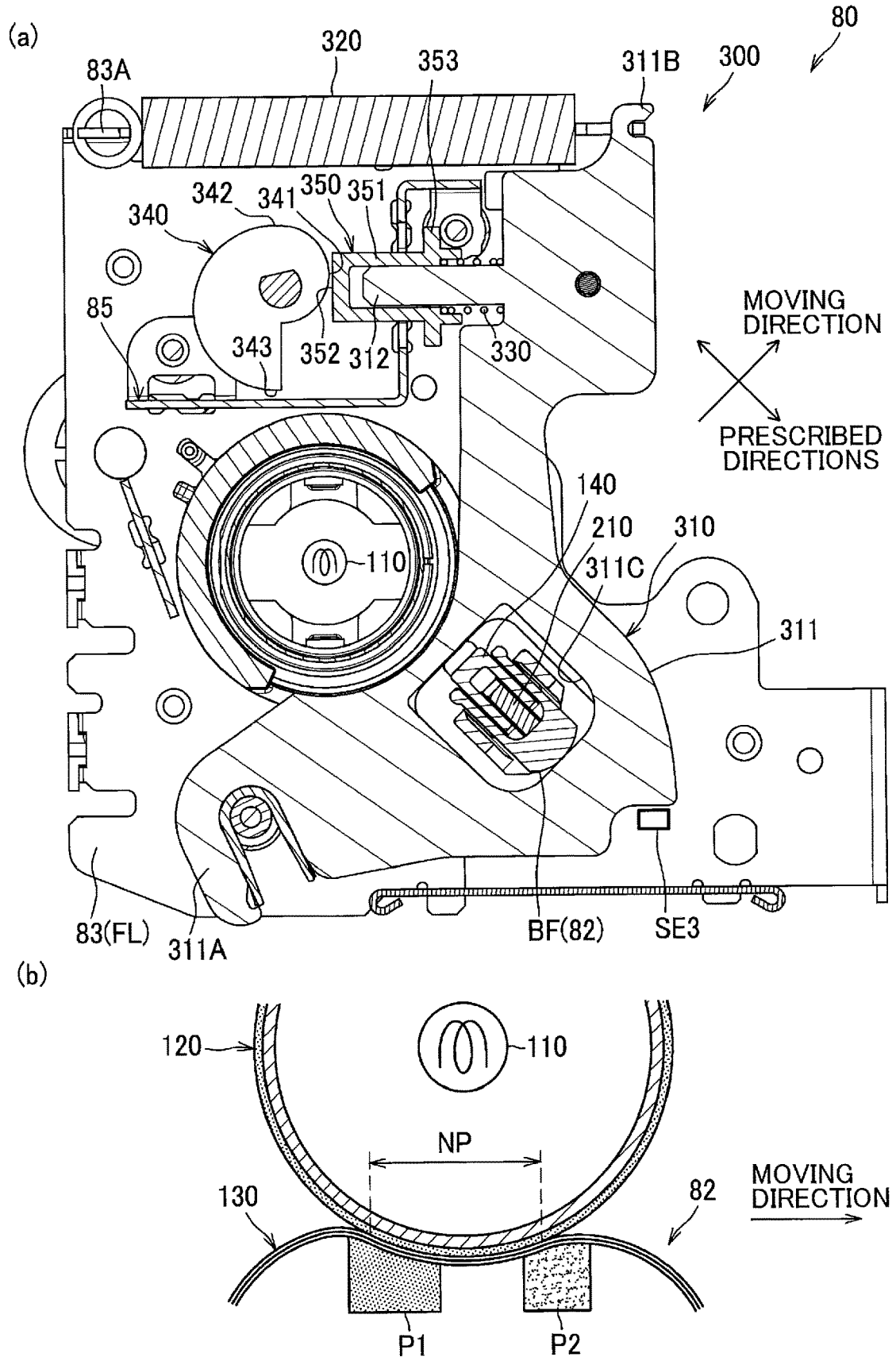
FIG. 5(*a*) is a cross-sectional view of the pressure-modifying mechanism when a cam of the pressure-modifying mechanism is at a first cam position, an arm body of the pressure-modifying mechanism is in a first orientation, and a nip pressure is the maximum nip pressure.

The pressure-modifying mechanism 300 modifies the nip pressure at the nip area NP. As shown in FIGS. 4 and 5(*a*), the pressure-modifying mechanism 300 is provided with pairs of arms 310, first springs 320, second springs 330, and cams 340. One each of the arms 310, the first springs 320, the second springs 330, and the cams 340 is provided on a one widthwise side and another widthwise side of the frame FL.

The arms 310 are members for pressing the first stay 210 through the buffer members BF. The arms 310 support the second fixing member 82 and is pivotally movably supported by the side frames 83.

Each arm 310 has an arm body 311, and a cam follower 350. The arm bodies 311 are L-shaped plate members formed of metal or the like.

Each arm body 311 has a first end 311A pivotally movably supported on the corresponding side frame 83, a second end 311B coupled to an end of the corresponding first spring 320, and an engaging hole 311C that supports the second fixing member 82. The engaging hole 311C is formed in a position between the first end 311A and the second end 311B, and is engaged with the corresponding buffer member BF.

The arm body 311 also has a guide protrusion 312 that extends toward the cam 340. The guide protrusion 312 is disposed between the second end 311B and the engaging hole 311C in a direction from the second end 311B to the engaging hole 311C.

The cam follower 350 is mounted over the guide protrusion 312 of the arm body 311 and is capable of moving relative to the guide protrusion 312 and capable of contacting the cam 340. The cam follower 350 is formed of a resin or the like. The cam follower 350 has a cylindrical part 351 that is fitted over the guide protrusion 312, a contact part 352 provided on one end of the cylindrical part 351, and a flange part 353 provided on the other end of the cylindrical part 351.

The cylindrical part 351 is supported by the guide protrusion 312 and is capable of moving in the direction that the guide protrusion 312 extends. The contact part 352 is a wall closing the opening formed in the end of the cylindrical part 351 on the cam 340 side. The contact part 352 is arranged between the cam 340 and the end of the guide protrusion 312. The flange part 353 protrudes from the other end of the cylindrical part 351 in directions orthogonal to a direction in which the cam follower 350 moves.

The second spring 330 is disposed between the cylindrical part 351 and the arm body 311. With this configuration, the arm body 311 can be urged by the first spring 320 and by the second spring 330.

The first spring 320 applies a first urging force to the second fixing member 82, and specifically applies the first urging force to the second fixing member 82 through the arm body 311.

More specifically, the first springs 320 urge the upstream pad P1 and the downstream pad P2 toward the rotor 120 through the arm bodies 311, the buffer members BF, the first stay 210, and the holder 140. The first springs 320 are tension coil springs formed of a metal or the like. One end of each first spring 320 is coupled with the spring-engaging part 83A of the corresponding side frame 83, while the other end is coupled with the second end 311B of the corresponding arm body 311.

The second spring 330 can apply a second urging force in the direction opposite the first urging force to the second fixing member 82, and specifically can apply the second urging force to the second fixing member 82 through the arm body 311. The second springs 330 are compression coil springs formed of a metal or the like. The second spring 330 is disposed between the corresponding cylindrical part 351 and the arm body 311 with the guide protrusion 312 inserted into the internal space formed in the compression coil spring 330.

The cam 340 is a member capable of changing the compressed state of the second spring 330 among a first compressed state in which the second urging force is not applied to the second fixing member 82, a second compressed state in which the second urging force is applied to the second fixing member 82, and a third compressed state in which the second spring 330 is further compressed from the second compressed state. The cam 340 is supported on the corresponding side frame 83 so as to be capable of pivotally moving (or rotating) among a first cam position shown in FIG. 5(*a*), an intermediate cam position (not shown) pivotally moved (or rotated) approximately 90 degrees clockwise in FIG. 5(*a*) from the first cam position, and a second cam position pivotally moved (or rotated) approximately 270 degrees clockwise in FIG. 5(*a*) from the first cam position (see FIG. 6(*a*)).

The cams 340 are formed of a resin or the like. Each cam 340 has a first region 341, a second region 342, and a third region 343. The first region 341, the second region 342, and the third region 343 are positioned along the circumferential surface of the cam 340.

The first region 341 is the area on the cam 340 that is positioned closest to the cam follower 350 when the cam 340 is in the first cam position. When the cam 340 is in the first cam position shown in FIG. 5(*a*), the first region 341 is separated from the cam follower 350.

The second region 342 is the area on the cam 340 that contacts the cam follower 350 when the cam 340 is in the intermediate cam position. More specifically, the second region 342 contacts the cam follower 350 when the cam 340 has been pivotally moved (or rotated) approximately 90 degrees clockwise in FIG. 5(*a*) from the first cam position. The distance from the second region 342 to the rotational center of the cam 340 is greater than the distance from the first region 341 to the rotational center of the cam 340.

Figure 6:
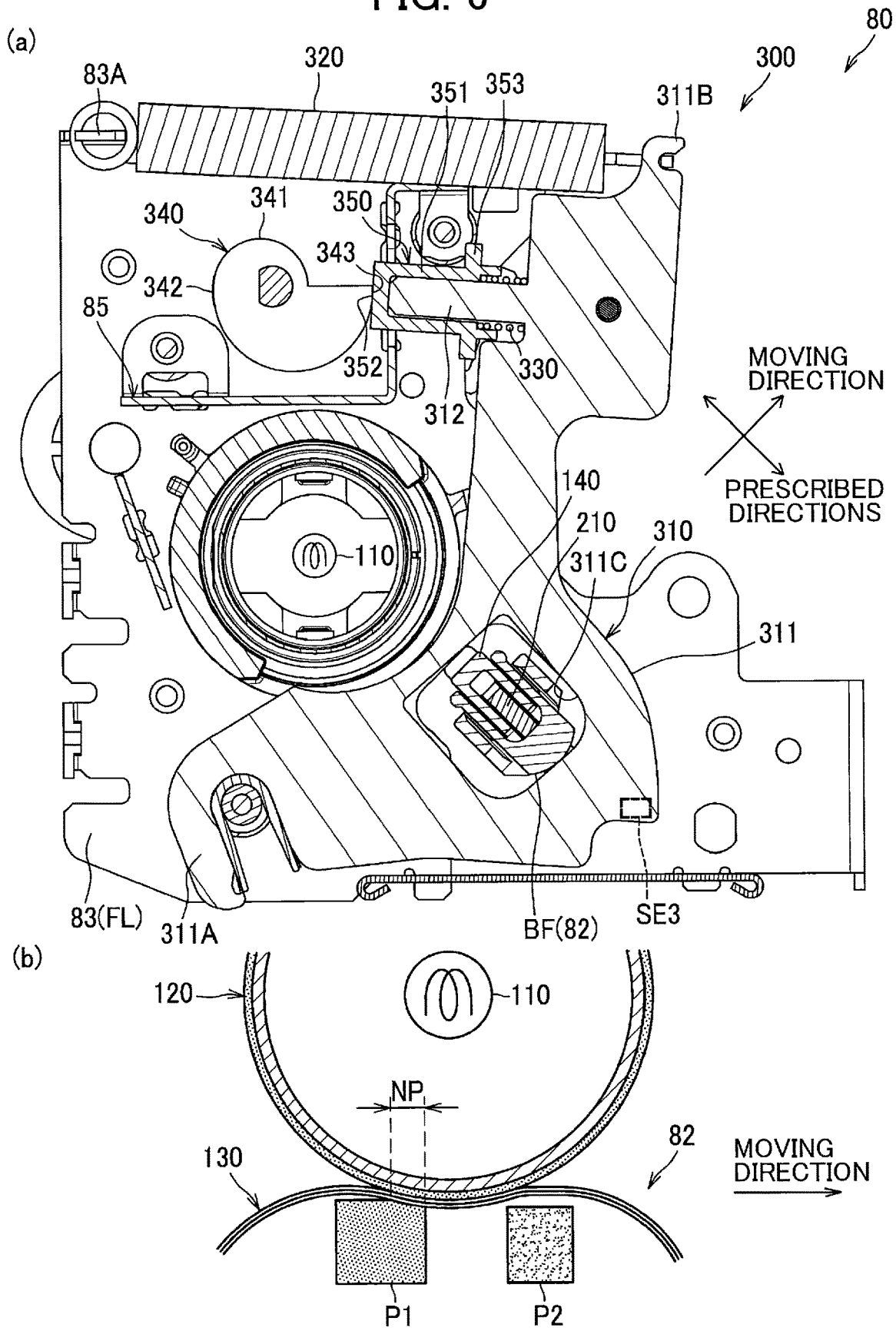
FIG. 6(*a*) is a cross-sectional view of the pressure-modifying mechanism when the cam is at a second cam position, the arm body is in a second orientation, and the nip pressure is the minimum nip pressure.

The third region 343 is the area on the cam 340 that contacts the cam follower 350 when the cam 340 is in the second cam position. More specifically, the third region 343 is the area of the cam 340 that contacts the cam follower 350 after the cam 340 has been pivotally moved (or rotated) clockwise in FIG. 5(*a*) approximately 270 degrees from the first cam position, as shown in FIG. 6(*a*), or when the cam 340 has been pivotally moved (or rotated) clockwise in FIG. 5(*a*) approximately 180 degrees from the intermediate cam position. The distance from the third region 343 to the rotational center of the cam 340 is greater than the distance from the second region 342 to the rotational center of the cam 340.

When the cam 340 is in the first cam position, the second spring 330 is in the first compressed state owing to the cam 340 being separated from the cam follower 350. When the cam 340 has placed the second spring 330 in the first compressed state in this way, the arm body 311 is in a first orientation shown in FIG. 5(*a*).

Specifically, when the cam 340 has placed the second spring 330 in the first compressed state, the cam 340 is separated from the cam follower 350 so that the second urging force of the second spring 330 is not applied to the second fixing member 82 via the arm body 311 and only the first urging force of the first spring 320 is being applied to the second fixing member 82 via the arm body 311. When the first spring 320 applies the first urging force to the second fixing member 82 while the second spring 330 does not apply the second urging force to the second fixing member 82 in this orientation, the nip pressure is a first nip pressure, specifically a maximum nip pressure.

When the cam 340 is pivotally moved (or rotated) from the first cam position shown in FIG. 5(*a*) to the intermediate cam position, the cam 340 contacts the cam follower 350 and moves the cam follower 350 a prescribed amount relative to the arm body 311. In a state where the cam 340 is moved to the intermediate cam position, the compressed state of the second spring 330 is deformed to the second compressed state, a state more compressed than the first compressed state.

Since the cam follower 350 is pressed by the cam 340 when the cam 340 is in the intermediate cam position, the second urging force of the second spring 330 is applied to the second fixing member 82 via the arm body 311 in a direction opposite the first urging force. Accordingly, when the first spring 320 applies the first urging force to the second fixing member 82 and the second spring 330 applies the second urging force to the second fixing member 82, the nip pressure changes to an intermediate nip pressure that is smaller than the first nip pressure.

Note that when the cam 340 places the second spring 330 in the second compressed state, the arm body 311 remains in the first orientation described above. Here, the downstream pad P2 is still pressed against the rotor 120 such that a load is being applied to the downstream pad P2. In a state where the downstream pad P2 is pressed against the rotor 120, that is, in a state where the load is being applied to the downstream pad P2, the downstream pad P2 remains substantially unchanged in shape, regardless of the magnitude of the load. Since the downstream pad P2 is substantially unchanged in shape, the stay 200 supporting the downstream pad P2 and the arm 310 supporting the stay 200 remain in a substantially fixed position irrespective of the magnitude of the load. Further, since the position of the upstream pad P1 is determined by the position of the downstream pad P2, the position of the upstream pad P1 does not change while the downstream pad P2 remains substantially unchanged in shape and position. Accordingly, the total nip width (the length from the entrance of the upstream nip area NP1 to the exit of the downstream nip area NP2) is no different for a strong nip (first nip pressure) and a weak nip (intermediate nip pressure) and, hence, the position of the arm 310 is maintained substantially constant.

Here, the downstream pad P2 does not deform under these circumstances because the downstream pad P2 has a sufficiently greater hardness than the upstream pad P1 and the elastic layer 122 of the rotor 120. More specifically, the downstream pad P2 has sufficient hardness to undergo almost no deformation at nip pressures required at the downstream nip area NP2 which are within a range from the maximum nip pressure (the downstream nip pressure in a strong nip) to the intermediate nip pressure (the downstream nip pressure in a weak nip).

In other words, the maximum nip pressure and the intermediate minimum nip pressure required for the downstream nip are set to magnitudes between which the downstream pad P2 undergoes almost no change in deformation.

Here, "the downstream pad P2 undergoes almost no change in deformation" allows for some deformation in the downstream pad P2, provided that the amount of change in the nip width of the downstream nip area NP2 formed by the downstream pad P2 (the nip length and position in the moving direction of the belt 130) does not affect sheet conveyance and image quality (i.e., the amount of change in the downstream nip width need not be zero).

In this way, since the arm body 311 is in the first orientation whether the compressed state of the second spring 330 is the first compressed state or the second compressed state, both the upstream pad P1 and the downstream pad P2 press the belt 130 against the rotor 120 whether the nip position is the first nip pressure or the intermediate nip pressure. Specifically, since the position of the second fixing member 82 relative to the rotor 120 is substantially the same for both the maximum and intermediate nip pressure states, the width of the nip area NP (length in the moving direction) is substantially the same for both states.

Here, the first nip pressure or the intermediate nip pressure is a nip pressure that is set for printing, and specifically for fixing toner images to sheets S. For example, the first nip pressure is used when the sheet S has a first thickness, while the intermediate nip pressure is used when the sheet S has a second thickness greater than the first thickness.

When pivotally moved (or rotated) from the intermediate cam position to the second cam position shown in FIG. 6(*a*), the cam 340 first moves the cam follower 350 further toward the arm body 311 and subsequently presses the arm body 311 through the cam follower 350. Consequently, the second spring 330 is deformed to the third compressed state, which is more compressed than the second compressed state, and the arm body 311 is pivotally moved from the first orientation to a second orientation different from the first orientation.

Specifically, in the initial stage of the process for pivotally moving (or rotating) the cam 340 from the intermediate cam position to the second cam position, the cam follower 350 moves relative to the arm body 311 so that the contact part 352 of the cam follower 350 approaches the distal end of the guide protrusion 312. When the contact part 352 contacts the distal end of the guide protrusion 312, the compressed state of the second spring 330 is in the third compressed state. When the cam 340 has placed the second spring 330 in the third compressed state in this way, the contact part 352 constituting part of the cam follower 350 is interposed between the cam 340 and the guide protrusion 312. That is, the contact part 352 is in contact with both the cam 340 and the guide protrusion 312. Thereafter, as the cam 340 is pivotally moved (or rotated) further, the cam 340 presses the guide protrusion 312 through the contact part 352, causing the arm body 311 to pivotally move against the urging force of the first spring 320 from the first orientation to the second orientation.

When the arm body 311 is placed in the second orientation through this operation, the second fixing member 82 is positioned farther away from the rotor 120 (the position in FIG. 6(*b*)) than when the arm body 311 is in the first orientation (the position in FIG. 5(*b*)). The position of the second fixing member 82 when the arm body 311 is in the first orientation will be called the "nip position" while the position of the second fixing member 82 when the arm body 311 is in the second orientation will be called the "nip reducing position."

When the second fixing member 82 is in the nip reducing position shown in FIG. 6(*b*), the rotor 120 is in contact with the belt 130 corresponding to a downstream portion of the upstream pad P1. Thus, in this case, the nip area NP is an area between the rotor 120 and the belt 130 corresponding to the downstream portion of the upstream pad P1. In this case, though the rotor 120 is in contact with the belt 130 in a region downstream of the upstream pad P1, almost no nip pressure is generated in this region. Accordingly, the nip area NP excludes the region downstream of the upstream pad P1. Although in this example the rotor 120 is in contact with a part of the belt 130 in a region downstream of the upstream pad P1, the rotor 120 may be separated from the part of the belt 130 in the region downstream of the upstream pad P1 when the second fixing member 82 is in the nip reducing position.

When the arm body 311 is placed in the second orientation, the position of the second fixing member 82 relative to the rotor 120 changes such that the width of the nip area NP is smaller than when the arm body 311 is in the first orientation and that the nip pressure is a second nip pressure which is smaller than the intermediate pressure. Specifically, the second nip pressure is a minimum nip pressure. In other words, by changing the orientation of the arm 310 with the cam 340, the nip pressure and the nip width are modified. Specifically, when the arm 310 is in the second orientation, the belt 130 is gripped only between the upstream pad P1 and the rotor 120 and not between the downstream pad P2 and the rotor 120. Consequently, when the arm 310 is in the second orientation, both the upstream nip pressure generated in the upstream nip area NP1 and the upstream nip width are reduced while the downstream nip pressure generated in the upstream nip area NP2 is eliminated. Put another way, when the arm 310 is in the second orientation, the upstream nip area NP1 is only a region where the nip pressure is generated whereas when the arm 310 is in the first orientation, both the upstream nip area NP1 and the downstream nip area NP2 are regions where the nip pressure is generated. Thus, the dimension of all the region(s) where the nip pressure is generated is smaller when the arm 310 is in the second orientation than when the arm is in the first orientation.

The second nip pressure is a nip pressure set for non-printing times when printing is not being performed, and specifically when a fixing motor M2 described later (see FIG. 7) is halted.

In the present embodiment, the belt 130 is pinched between the upstream pad P1 and the rotor 120 when the nip pressure is set to the second nip pressure, but the present disclosure is not limited to this configuration. For example, the belt 130 need not be pinched between the upstream pad P1 and the rotor 120 when the nip pressure is the second nip pressure. In this case, the second nip pressure is zero.

Figure 7:
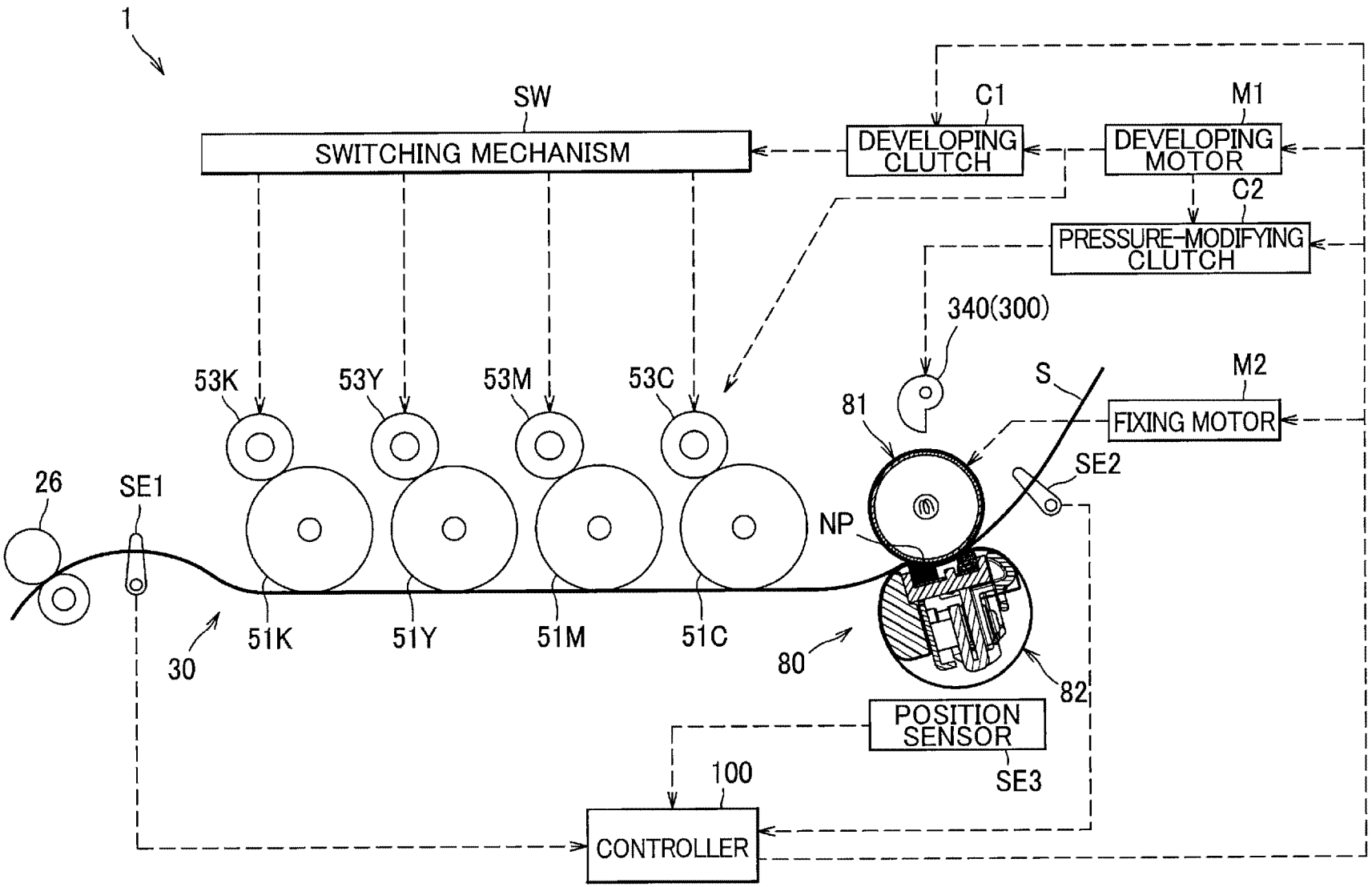
FIG. 7 is an explanatory diagram illustrating a relationship between a controller and components of the color printer according to the embodiment of the present disclosure, the components being controlled by the controller.

As shown in FIG. 7, the color printer 1 is also provided with a developing motor M1, a fixing motor M2, a developing clutch C1, a switching mechanism SW, a pressure-modifying clutch C2, a first sheet sensor SE1, a second sheet sensor SE2, and a position sensor SE3.

The developing motor M1 is configured to be rotatable in forward and reverse directions and is primarily provided for driving each developing roller 53 to rotate. In the present embodiment, the rotating direction of the developing motor M1 during printing will be called the forward direction. The developing motor M1 is coupled to the developing rollers 53 via gears and a clutch (not shown) to rotate the developing rollers 53. The developing motor M1 is also coupled to the switching mechanism SW via the developing clutch C1 and gears (not shown). The developing motor M1 is also coupled to the cam 340 of the pressure-modifying mechanism 300 via the pressure-modifying clutch C2 and gears (not shown).

The fixing motor M2 is provided for driving the first fixing member 81 to rotate. The fixing motor M2 is an example of the motor of the present disclosure.

The developing clutch C1 is an electromagnetic clutch, for example. The developing clutch C1 can change between a first transmission state for transmitting the drive force of the developing motor M1 to the switching mechanism SW, and a first cutoff state for not transmitting the drive force of the developing motor M1 to the switching mechanism SW.

The switching mechanism SW is provided for switching the states of the developing rollers 53 between a contact state in which the developing rollers 53 are pressed against the photosensitive drums 51, and a separated state in which the developing rollers 53 are separated from the photosensitive drums 51. The switching mechanism SW switches the developing rollers 53 from the separated state to the contact state when the developing clutch C1 is set to the first transmission state under a condition that the developing rollers 53 are in the separated state and the developing motor M1 is rotating in the forward direction. The switching mechanism SW switches the developing rollers 53 from the contact state to the separated state when the developing clutch C1 is set to the first transmission state under a condition that the developing rollers 53 are in the contact state and the developing motor M1 is rotating in the forward direction.

The pressure-modifying clutch C2 is an electromagnetic clutch, for example. The pressure-modifying clutch C2 can change between a second transmission state for transmitting the drive force of the developing motor M1 to the cam 340 of the pressure-modifying mechanism 300, and a second cutoff state for not transmitting the drive force of the developing motor M1 to the cam 340. The cam 340 pivotally moves (or rotates) counterclockwise in the drawings from the second cam position shown in FIG. 6(*a*) to the first cam position shown in FIG. 5(*a*) when the pressure-modifying clutch C2 is placed in the second transmission state under a condition that the cam 340 is in the second cam position and the developing motor M1 is rotating in the forward direction. The cam 340 pivotally moves (or rotates) clockwise in the drawings from the first cam position shown in FIG. 5(*a*) toward the second cam position shown in FIG. 6(*a*) when the pressure-modifying clutch C2 is placed in the second transmission state under a condition that the cam 340 is in the first cam position and the developing motor M1 is rotating in the reverse direction.

The first sheet sensor SE1 and the second sheet sensor SE2 function to detect the presence or absence of a sheet S. Each of the sheet sensors SE1 and SE2 is provided with a pivoting lever that pivots when pressed by a sheet S conveyed in the conveying direction, and a photosensor that detects the pivoting of the pivot lever. In the present embodiment, the sheet sensors SE1 and SE2 are set to ON when a sheet S is passing, i.e., when the pivoting lever is being pushed over by a sheet S, and are set to OFF when a sheet S is not passing, i.e., when the pivoting lever is not being pushed over by a sheet S. However, the relationship between the orientation of the pivoting levers and the ON/OFF signals from the sheet sensors SE1 and SE2 may be reversed.

The expression "a sensor for detecting a prescribed event" in this specification signifies a sensor for outputting a signal that enables the controller 100 to determine whether a prescribed event has occurred. For example, the "sensor for detecting the presence or absence of a sheet S" described above denotes a sensor that outputs a signal by which the controller 100 can determine the presence or absence of a sheet S.

In the present embodiment, if the sheet sensor SE1 or SE2 is ON, the controller 100 determines that a sheet S is present at the position of the sheet sensor SE1 or SE2. If the sheet sensor SE1 or SE2 is OFF, the controller 100 determines that a sheet S is not present at the corresponding position of the sheet sensor SE1 or SE2.

The first sheet sensor SE1 is disposed upstream of the fixing device 80 in the conveying direction of the sheet S. Specifically, the first sheet sensor SE1 is disposed downstream of the registration rollers 26 and upstream of the image-forming section 30 in the conveying direction of the sheet S.

The second sheet sensor SE2 is provided for detecting the presence or absence of a sheet S in the fixing device 80. The second sheet sensor SE2 is disposed downstream of the nip area NP in the conveying direction of the sheet S.

The position sensor SE3 is provided for detecting the position of the second fixing member 82. Specifically, the position sensor SE3 is disposed near the nip reducing position and detects the second fixing member 82 when the second fixing member 82 nears the nip reducing position. FIG. 5(*a*) shows an example in which the position sensor SE3 is disposed in a position capable of detecting pivoting of the arm body 311. However, the position sensor SE3 may be disposed in any position capable of detecting a member that moves in association with movement of the second fixing member 82.

The position sensor SE3 may be configured of a photosensor having a light-emitting unit and a light-receiving unit, for example. When the second fixing member 82 is in the nip position (when the arm body 311 is in the first orientation) as shown in FIG. 5(*a*), light emitted from the light-emitting unit is not blocked by the arm body 311 and is received by the light-receiving unit. When the second fixing member 82 is in the nip reducing position (when the arm body 311 is in the second orientation) as shown in FIG. 6(*a*), light emitted from the light-emitting unit is blocked by the arm body 311 and, hence, not received by the light-receiving unit. The position sensor SE3 configured in this way can detect when the second fixing member 82 approaches the nip reducing position.

Figure 8:
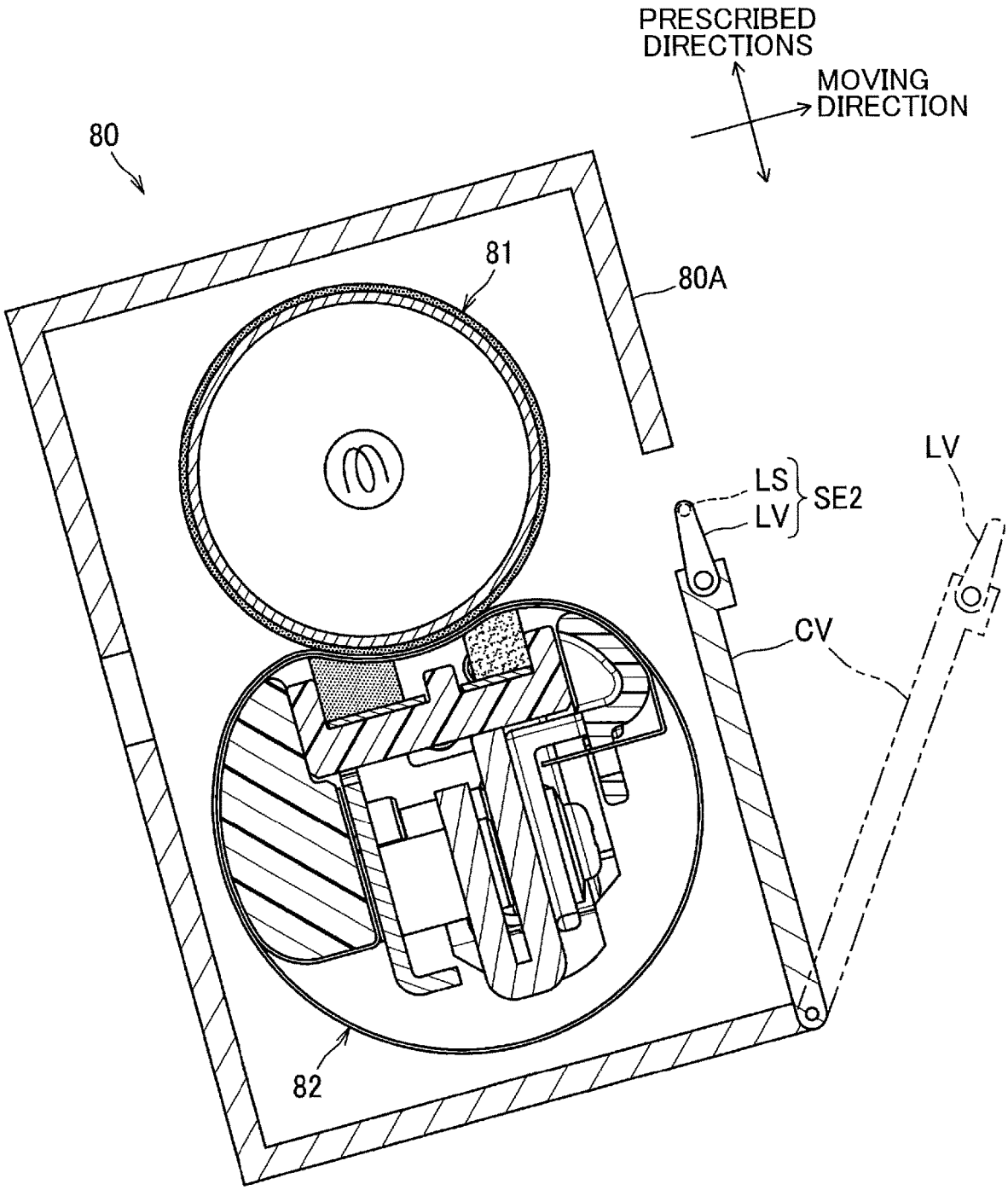
FIG. 8 is a cross-sectional view of the fixing device including a cover and a second sheet sensor, in which a solid line indicates a state where the cover is in a first position and a dashed-two dotted line indicates a state where the cover is in a second position.

As shown in FIG. 8, the fixing device 80 is further provided with a housing 80A enclosing the first fixing member 81 and the second fixing member 82, and a cover CV rotatably supported on the housing 80A. The cover CV is capable of moving between a first position for covering the second fixing member 82 (indicated by a solid line in FIG. 8), and a second position for exposing the second fixing member 82 (indicated by a dashed-two dotted line in FIG. 8). The second sheet sensor SE2 is provided with a pivoting lever LV, and a photosensor LS that detects pivoting of the pivoting lever LV.

The pivoting lever LV is rotatably supported on the cover CV. The photosensor LS is provided on the housing 80A of the fixing device 80. When the cover CV is in the first position and the pivoting lever LV is not being pushed over by a sheet S, the pivoting lever LV is disposed in a position for blocking light emitted by the photosensor LS. Accordingly, when the cover CV is in the first position, the second sheet sensor SE2 can detect the passing of a sheet S because the pivoting lever LV pivots in response to the sheet S passing.

When the cover CV is in the second position, the pivoting lever LV is positioned outside the path of light emitted by the photosensor LS. Accordingly, the second sheet sensor SE2 can also detect opening and closing of the cover CV. As a specific example, if the pivoting lever LV blocks light emitted from the photosensor LS prior to a sheet S being fed, the second sheet sensor SE2 is OFF and, hence, can detect that the cover CV is in the first position, i.e., is closed. Alternatively, if the pivoting lever LV is outside the path of light emitted from the photosensor LS prior to a sheet S being fed, the second sheet sensor SE2 is ON and, hence, can indicate that the cover CV is in the second position, i.e., is open.

As shown in FIG. 7, the controller 100 is provided with a CPU, a RAM, a ROM, a nonvolatile memory, ASICs, input/output circuits, and the like. The controller 100 executes various processes by performing computational operations based on print commands outputted from an external computer, signals outputted from the sensors SE1-SE3 and programs and data stored in a ROM and the like.

The controller 100 is configured to perform an energizing process, a rotating process, a setting process, a conveying process, an image-forming process, and a fixing process when performing the image formation with the color printer 1. The energizing process is performed to energize the heater 110 to heat the first fixing member 81. The rotating process is performed to rotate the fixing motor M2 to rotate the first fixing member 81. The setting process is performed to control the pressure-modifying mechanism 300 to set the nip pressure at the nip area NP to the first nip pressure. The conveying process is performed to control the sheet-feeding mechanism 22 and registration rollers 26 to convey a sheet S toward the image-forming section 30. The image-forming process is performed to control the image-forming section 30 to form a developer image on a sheet S. The fixing process is performed to control the fixing device 80 to fix the developer image on the sheet S.

The controller 100 is configured to perform a rotation halting process, a nip pressure reducing process, a heat halting process, and a determination process.

The rotation halting process is performed to halt rotation of the first fixing member 81 and the second fixing member 82. The nip pressure reducing process is performed to change the nip pressure from the first nip pressure to the second nip pressure. The heat halting process is performed to halt heating with the heater 110. The determination process is performed to determine that a sheet jam has occurred in the color printer 1 and whether a sheet S exists in the nip area NP when the sheet jam has occurred.

The controller 100 is configured to perform a process for determining whether the sheet has jammed in the color printer 1. This process is performed using various sheet sensors disposed along the conveying path of the sheet S. Specifically, if a prescribed sheet sensor has not switched on despite a prescribed time having elapsed after a sheet sensor disposed upstream of the prescribed sheet sensor turned on, the controller 100 can determine that the sheet S jammed upstream of the prescribed sensor. Alternatively, if the first sheet sensor SE1 has not switched on even after a prescribed time elapsed since beginning to feed the sheet S, the controller 100 can determine that the sheet S became jammed upstream of the first sheet sensor SE1.

If the controller 100 determines in the determination process that the sheet S has not begun passing the second sheet sensor SE2 after the prescribed time that is has elapsed since the sheet S passed the first sheet sensor SE1, that is, at the time when the sheet S is scheduled to pass through the second sheet sensor SE2, the controller 100 determines that a sheet jam has occurred and the sheet S exists in the nip area NP. In the present embodiment, the controller 100 determines in the determination process that the sheet S exists in the nip area NP even if the sheet S has jammed in the image-forming section 30 because the first sheet sensor SE1 is disposed upstream of the image-forming section 30. Hence, the controller 100 determines in the determination process that a sheet jam has occurred and the sheet S exists in the nip area NP in the present embodiment when there is a possibility that the sheet S exists in the nip area NP. When the controller 100 determines that the sheet S exists in the nip area NP, the controller 100 sets an error type to a first jam error indicating that the sheet S exists in the nip area NP.

If there is no sheet being conveyed other than the jammed sheet S, or if no sheet S' different from the jammed sheet S exists in the nip area NP, the controller 100 sets the error type to a second jam error indicating that no sheet S exists in the nip area NP.

When the sheet S jams in a location other than the nip area NP and has not jammed in the nip area NP, i.e., when the error type is the second jam error, the controller 100 executes the rotation halting process after first executing the nip pressure reducing process. Additionally, when the error type is the second jam error, the controller 100 decreases the rotational speed of the first fixing member 81 prior to initiating the nip pressure reducing process to a speed less than the rotational speed used during printing.

When the sheet S has not become jammed in a location other than the nip area NP but has become jammed in the nip area NP, i.e., when the error type is the first jam error, the controller 100 executes the nip pressure reducing process after executing the rotation halting process. When the sheet S has jammed in a location other than the nip area NP and has jammed in the nip area NP, i.e., when the error type is set both to the first jam error and to the second jam error, the controller 100 executes the nip pressure reducing process after executing the rotation halting process. In other words, when the sheet S has jammed in the nip area NP, the controller 100 executes the nip pressure reducing process following execution of the rotation halting process irrespective of whether the sheet S has also jammed in a location other than the nip area NP.

The controller 100 has a function for determining whether the cover CV is in the second position, that is, whether the cover CV is open. The controller 100 makes this determination according to signals received from the second sheet sensor SE2. Specifically, the controller 100 determines whether the cover CV is open by determining whether the second sheet sensor SE2 is ON during a period in which a sheet S cannot be passing the various sheet sensors (the sheet sensors SE1 and SE2, for example). Each sheet sensor is only on for a period of time corresponding to the length of the sheet S within a period from the start timing for feeding the sheet S and until the sheet S is completely discharged. Since the time that each sheet sensor turns on can be known in advance, all times excluding these times can be set as intervals in which sheets S cannot be passing the various sheet sensors.

If the controller 100 determines that the cover CV is in the second position, the controller 100 sets the error type to a cover open error indicating that the cover CV is open. If the cover CV is in the second position (i.e., when the error type is the cover open error), the controller 100 executes the nip pressure reducing process after executing the rotation halting process.

When a sheet S becomes jammed in the nip area NP or a location other than the nip area NP, or when the cover CV is in the second position, the controller 100 executes the heat halting process prior to executing the rotation halting process and the nip pressure reducing process. In other words, the controller 100 first executes the heat halting process when an error of any type is set during printing.

Next, the operations of the controller 100 will be described in detail with reference to FIG. 9. When the controller 100 determines that an error occurred during printing, the controller 100 sets the error type and subsequently executes the error process shown in FIG. 9.

In S1 of the error process, the controller 100 first executes the heat halting process to stop the heater 110 from generating heat. In S2 the controller 100 determines whether the sheet S became jammed in the nip area NP by determining whether the error type is the first jam error.

If the controller 100 determines in S2 that the sheet S did not jam in the nip area NP (S2: NO), in S3 the controller 100 determines whether the cover CV is open by determining whether the error type is the cover open error. If the controller 100 determines that the cover CV is not open (S3: NO), in S4 the controller 100 continues driving the fixing motor M2 but reduces the rotational speed of the fixing motor M2. Thus, the controller 100 executes the process in S4 when the error type is any error other than the first jam error and the cover open error, such as the second jam error.

After completing the process in S4, the controller 100 executes the nip pressure reducing process in S5 and the rotation halting process in S6, and subsequently ends the error process. On the other hand, if the controller 100 determines that the sheet has jammed in the nip area NP (S2: YES) or determines that the cover CV is open (S3: YES) (i.e., if the error type is either the first jam error or the cover open error), the controller 100 executes the rotation halting process in S7 and the nip pressure reducing process in S8, and subsequently ends the error process.

The following effects can be obtained in the present embodiment described above.

Since the rotation halting process is executed prior to the nip pressure reducing process when the sheet S becomes jammed in the nip area NP, irrespective of whether the sheet S has jammed in a location other than the nip area NP, rotation of the first fixing member 81 and second fixing member 82 is halted together with the sheet-feeding mechanism 22 and registration rollers 26 and the operation of the image-forming section 30 is also halted. Accordingly, the sheet S jammed in the nip area NP can be suppressed from wrapping around the first fixing member 81 or the like as the first fixing member 81 and the second fixing member 82 rotate. Further, since the nip pressure reducing process is executed prior to the rotation halting process when the sheet S becomes jammed in a location other than the nip area NP while an occurrence of the first jam error or the cover open error has not been determined, the method of the present embodiment can suppress wear on the belt 130 caused by the first fixing member 81 continuing to rotate at a strong nip pressure (the first nip pressure or the intermediate nip pressure).

Since the rotation halting process is executed prior to the nip pressure reducing process when the cover CV is in the second position, irrespective of whether the sheet S has jammed in a location other than the nip area NP, the present embodiment can reduce the likelihood of the user accidentally touching the first fixing member 81 or the second fixing member 82 while the first fixing member 81 and the second fixing member 82 are rotating.

The method in the present disclosure can reduce costs by using a single sheet sensor (second sheet sensor) SE2 both to detect the presence of a sheet S in the fixing device 80 and to detect the opening and the closing of the cover CV.

When a sheet S becomes jammed in a location other than the nip area NP while the occurrence of a first jam error or a cover open error has not been determined, the controller 100 reduces the rotational speed of the first fixing member 81 or the second fixing member 82, which continues to be rotated until the rotation halting process begins, from the speed used during printing. This method can increase the lifespan and improve quietness of the fixing device 80.

While the description has been made in detail with reference to a specific embodiment, it would be apparent to those skilled in the art that many modifications and variations may be made thereto.

In the embodiment, the pressure-modifying mechanism 300 is configured to modify the nip pressure of the nip area NP among the first nip pressure, the intermediate nip pressure, and the second nip pressure. However, the pressure-modifying mechanism should be capable of modifying the nip pressure at the nip area between at least the first nip pressure and the second nip pressure. The pressure-modifying mechanism may be configured to modify the nip pressure among four or more pressure values, for example.

The pressure-modifying mechanism is not limited to the construction described in the embodiment. For example, the pressure-modifying mechanism may be configured of a structure similar to that shown in FIG. 5(*a*) but excluding the cam follower 350 and the second spring 330, for example. In other words, the cam 340 may be configured to contact the arm body 311.

While the cover CV is configured to cover the second fixing member 82 in the present embodiment, the cover may be configured to cover the first fixing member or to cover both the first fixing member and the second fixing member. Alternatively, the cover may be configured to cover only a portion of the first fixing member or the second fixing member.

Figure 9:
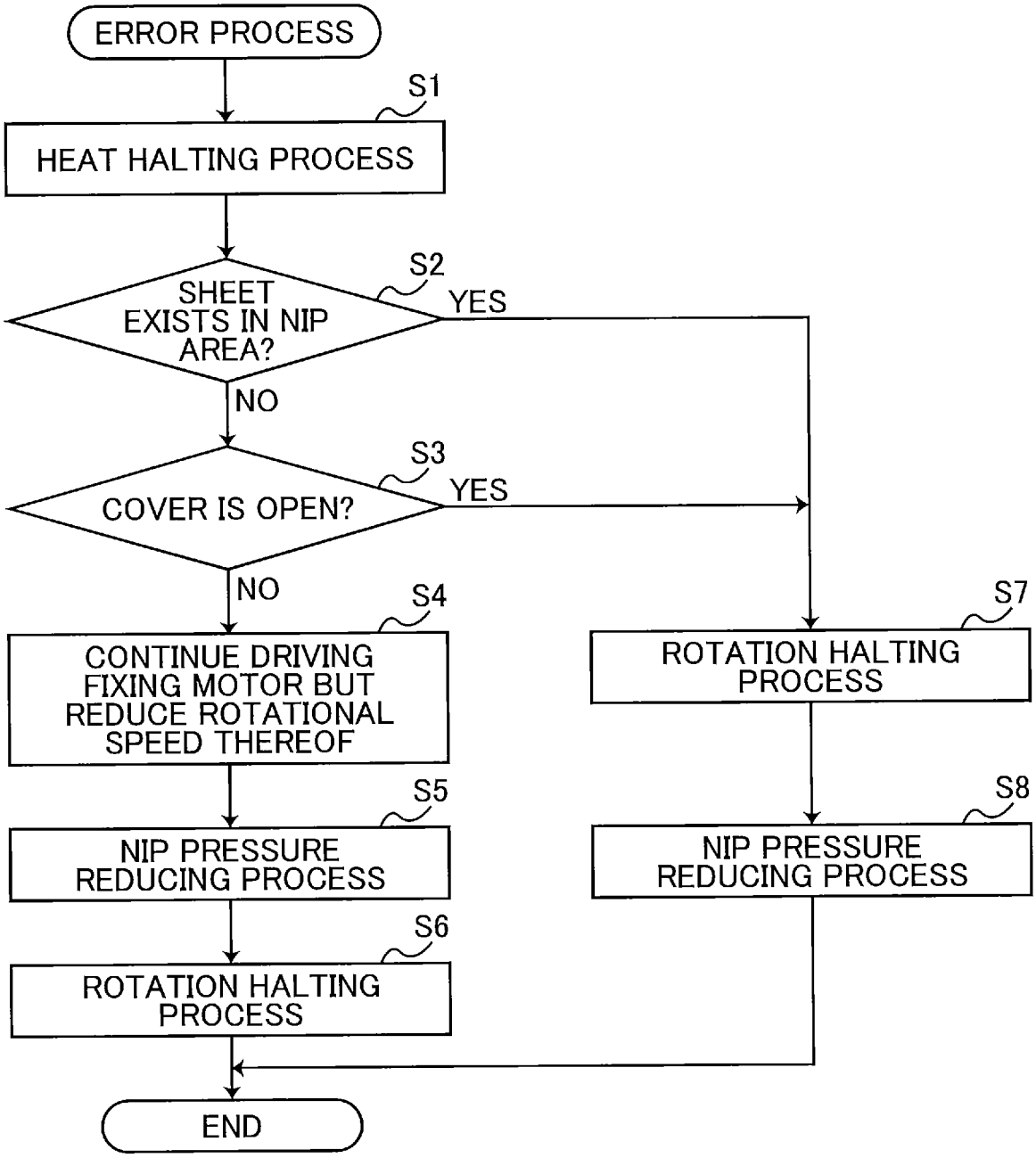
FIG. 9 is a flowchart illustrating steps in an error process executed by the controller of the color printer according to the embodiment of the present disclosure.

While the controller 100 determines in S3 of the error process shown in FIG. 9 of the present embodiment whether a cover open error has occurred, the determination process of S3 may be omitted. The process of S4 is also optional.

The second sheet sensor SE2 is disposed downstream of the nip area NP in the present embodiment, but a second sheet sensor may be disposed upstream of the nip area instead, for example. Alternatively, a cover sensor for detecting opening and closing of the cover may be provided in addition to the second sheet sensor that detects the presence of a sheet. In this case, the controller 100 may determine that a sheet has jammed in the nip area when the time during which the fixing sheet sensor is on exceeds the time corresponding to the length of the sheet, for example.

Additionally, the first sheet sensor SE1 may be arranged upstream of the registration rollers 26, for example, provided that the first sheet sensor SE1 is arranged upstream of the fixing device 80.

Although the present disclosure is applied to the color printer 1 in the present embodiment, the present disclosure may instead be applied to another image-forming apparatus, such as a monochrome printer, a copying machine, or a multifunction peripheral.

While a halogen lamp is used as an example of the heater in the present embodiment, the heater may be a carbon heater or the like.

While the first fixing member in the present embodiment is described as a cylindrical roller with a built-in heater 110, the first fixing member of the present disclosure may be an endless belt having a heater for heating the inner surface of the belt. Alternatively, the heater may be disposed outside the first fixing member and may employ an external heating system or an induction heating system to heat the outer surface of the first fixing member. Further, a heater may be provided in the second fixing member and may heat the first fixing member indirectly as the first fixing member contacts the outer surface of the second fixing member. Alternatively, both the first fixing member and the second fixing member may be provided with built-in heaters. The second fixing member may also be a pressure roller or the like having a shaft, and a rubber layer formed around the shaft.

The technical elements described above in the embodiment and its variations may be used in any suitable combination.

What is claimed is:

1. An image-forming apparatus comprising:

an image-forming section configured to form a developer image on a sheet;

a sheet feeder configured to feed a sheet toward the image-forming section;

a fixing device configured to fix a developer image on a sheet, the fixing device comprising:

a first fixing member configured to rotate;

a heater configured to heat the first fixing member;

a motor configured to drive the first fixing member;

a second fixing member configured to form a nip together with the first fixing member, the second fixing member being rotatable by following the first fixing member rotating; and a pressure modifying mechanism configured to modify a nip pressure at the nip to one of a first nip pressure and a second nip pressure smaller than the first nip pressure; and a controller configured to perform:

energizing the heater to heat the first fixing member;

rotating the motor to rotate the first fixing member;

controlling the pressure modifying mechanism to set the nip pressure to the first nip pressure; and controlling the sheet feeder to feed a sheet toward the image-forming section, wherein in a first case where a sheet jam occurs in the image-forming apparatus and no sheet exists in the nip, the controller performs: reducing the nip pressure from the first nip pressure to the second nip pressure; and halting rotation of the first fixing member after completed the reducing, and wherein in a second case where a sheet jam occurs in the image-forming apparatus and a sheet exists in the nip, the controller performs: the halting; and the reducing after completed the halting.

2. The image-forming apparatus according to claim 1, wherein the fixing device further comprises a cover movable between a first position and a second position, the cover covering at least part of the first fixing member and the second fixing member in the first position, the cover exposing the at least part of the first fixing member and the second fixing member in the second position, and wherein in a third case where the cover is moved from the first position to the second position, the controller performs: the halting; and the reducing after completed the halting.

3. The image-forming apparatus according to claim 2, wherein the fixing device further comprises a sheet sensor configured to detect a sheet in the fixing device, the sheet sensor being configured to further detect opening and closing of the cover.

4. The image-forming apparatus according to claim 1, wherein in the first case, the controller reduces a rotational speed of the first fixing member from a speed at which the first fixing member rotates during printing prior to performing the reducing.

5. The image-forming apparatus according to claim 1, wherein in the first case or in the second case, the controller performing stopping the heater from being energized prior to performing the halting and the reducing.

6. The image-forming apparatus according to claim 1, wherein in the first case or in the second case, the controller performs controlling the sheet feeder to stop feeding the sheet.

7. The image-forming apparatus according to claim 1, further comprising:

a first sheet sensor disposed upstream of the fixing device in a conveying direction of a sheet and configured to detect the sheet; and a second sheet sensor disposed downstream of the fixing device in the conveying direction of the sheet and configured to detect the sheet, wherein the controller is configured to further perform:

determining whether a sheet passes the second sheet sensor a prescribed time after the sheet passes the first sheet sensor according to a signal from the first sheet sensor and a signal from the second sheet sensor, and wherein when the determining determines that the sheet does not pass the second sheet sensor, the controller determines that the sheet jam occurs and a sheet exists in the nip.

8. The image-forming apparatus according to claim 1, wherein the second fixing member comprises:

a belt;

an upstream pad configured to pinch the belt together with the first fixing member;

a downstream pad disposed downstream of the upstream pad in a conveying direction of a sheet and configured to pinch the belt together with the first fixing member, wherein when the nip pressure is the first nip pressure, both the upstream pad and the downstream pad pinch the belt together with the first fixing member, and wherein when the nip pressure is the second nip pressure, the upstream pad pinches the belt together with the first fixing member whereas the downstream pad does not pinch the belt together with the first fixing member.

* * * * *